US006825477B2

(12) United States Patent
Sunner et al.

(10) Patent No.: US 6,825,477 B2
(45) Date of Patent: Nov. 30, 2004

(54) METHOD AND APPARATUS TO PRODUCE GAS PHASE ANALYTE IONS

(76) Inventors: Jan Sunner, 2615 Langohr, Bozeman, MT (US) 59715; Sergey Alimpiev, 119991 Vavilov str. 38, Moscow (RU); Sergey Nikiforovl, 119991, Vavilov str. 38, Moscow (RU)

( * ) Notice: Subject to any disclaimer, the term of this patent is extended or adjusted under 35 U.S.C. 154(b) by 0 days.

(21) Appl. No.: 10/083,647

(22) Filed: Feb. 27, 2002

(65) Prior Publication Data

US 2002/0121595 A1 Sep. 5, 2002

Related U.S. Application Data

(60) Provisional application No. 60/271,709, filed on Feb. 28, 2001.

(51) Int. Cl.[7] ..... H01J 49/00

(52) U.S. Cl. ..... 250/423 P; 250/424; 250/423 R; 250/281

(58) Field of Search ..... 250/423 R, 424, 250/425, 423 P

(56) References Cited

U.S. PATENT DOCUMENTS 5,854,486 A * 12/1998 Dreyfus ..... 250/288

* cited by examiner

*Primary Examiner*—Nikita Wells
*Assistant Examiner*—Christopher M. Kalivoda
(74) *Attorney, Agent, or Firm*—Morgan Lewis & Bockius LLP

(57) ABSTRACT

Adsorption, desorption and ionization methods and apparatuses are used to produce gas phase ions for subsequent analysis. Non-porous microscopically rough ionization surfaces are used to absorb analyte in situ for subsequent ionization by laser light and release of gas phase analyte ions.

61 Claims, 5 Drawing Sheets

METHOD AND APPARATUS TO PRODUCE GAS PHASE ANALYTE IONS

This application claims benefit of Provisional Appl. 60/271,709 filed Feb. 28, 2001.

FIELD OF THE INVENTION

This invention relates to desorption and ionization methods and apparatuses to produce gas phase ions for subsequent analysis. More particularly, it relates to ionization of gaseous analytes subsequent to adsorption of the gaseous analyte to an ionization surface.

BACKGROUND OF THE INVENTION

This invention generally relates to methods and apparatuses for the adsorption, desorption, and ionization of an analyte for analysis of the ionized analyte by such analytical methods as, for example, mass spectrometry.

How analytes are ionized depends on the volatility of the analyte. That is, volatile analytes are typically ionized into the gas phase, by methods such as electron ionization (EI), chemical ionization (CI), or photoionization by lasers. Involatile analytes are either desorbed from surfaces by energy input or desorbed in liquid sprays and detected as ions. Desorption from surfaces occurs in methods such as laser desorption (LD), secondary ion mass spectrometry (SIMS), and matrix-assisted laser desorption (MALDI). Desorption from liquid sprays occur in methods, such as electrospray (ES) and thermospray (TSP).

These methods of analyte ionization produce a variety of both positive and negative analyte ions. Positive ions include molecular ions ($M^+$), protonated molecules ($MH^+$), cationized molecules ($A^+(M)$), and various fragment ions ($F_1^+$). Negative ions include molecular ions ($M^-$), deprotonated molecules ($(M-H)^-$), anionized molecules ($X^-(M)$), and fragment ions ($F^-$).

The positively and negatively charged analyte ions can then be extracted from the ion source by an electric field, and separated according to their m/z ratios, using magnetic sector, quadrupole, time-of-flight, Fourier-transform, ion trap, or other types of mass spectrometers. The molecular identity of the analyte can usually be determined from the measured mass-to-charge ratios of the structurally significant ions.

Some ionization methods involve deposition of the analyte on a surface. In LD, analytes are deposited on a surface, usually metal, which is then irradiated with a laser to produce structurally significant ions for lower molecular weight materials (generally less than about 1,000 Da). In MALDI, which is primarily used for larger analytes, such as proteins, analytes are deposited on a surface together with a large excess of matrix. Isolating the analyte in the matrix is considered necessary in order to observe analyte ions. In SIMS, analytes are deposited on a surface, which is then bombarded with keV-kinetic energy primary ions, which cause secondary ions to be emitted from the surface. Another ionization method that involves surfaces is surface-assisted laser desorption ionization (SALDI). In SALDI laser irradiation is used to desorb ions from suspensions of solid carbon powders in a liquid matrix and from beds of carbon powders immobilized on a substrate. Here it is believed that the individual particles protrude above the surface of the liquid matrix.

Yet another surface ionization method is "hot wire" surface ionization. In this method, gaseous molecules are ionized in the vicinity of a hot (ca. 600° C.) filament. This method gives primarily fragment ions and the surface topography is not a factor.

Another surface ionization method set forth in U.S. Pat. No. 6,288,390 is desorption ionization from porous silicon (DIOS) wherein analyte ions are obtained by irradiating a porous silicon substrate loaded with analyte. The silicon substrate is described as having a porosity, measured gravimetrically, from approximately 4% to substantially 100%, with 60–70% porosity most preferred. The porous silicon substrate is formed by chemical etching with an ethanol/hydrofluoric acid mixture. Analyte is adsorbed or loaded onto the porous substrate prior to inserting the loaded substrate into the analyzing instrument where the substrate is irradiated, which then causes desorption of ionized analyte. The porosity of the substrate surface is critical to the ability to load the substrate with analyte molecules.

When gas phase analytes are analyzed, the analyte typically is maintained in the gas phase for both the ionization process and subsequent analysis. However, where the gaseous analyte has associated with a substrate surface prior to ionization such as in, for example, field ionization (FI) and field desorption (FD) methods, the ionization of the interacted gaseous analyte is accomplished by application of electric voltage to the substrate itself. Critical to this method is the presence of very sharp edges and tips on the substrate. The electric potential applied to the substrate creates extremely high electric fields at such tips and edges. The ionization of the analyte is a direct result of these high electric fields. Application of external sources of energy, such as laser light, onto the surface has limited or no effect on the mass spectra obtained.

Thus, except for FI, FD, and surface ionization, where ionization occurs by application of either an electric field or temperature in the immediate vicinity of the surface, mass spectrometry procedures used to analyze gases and gaseous mixtures rely on the ionization in the gas phase of the analyte.

All of the above described procedures for producing ionized particles are limited by low ionization efficiency for structurally significant ions. In the gas phase, ionization efficiency is determined by the cross section for the elementary ionization process, the flux of ionizing particles or photons, and the time that the gaseous analyte molecules spend in the ionization region. For the most commonly used ionization methods (electron ionization and chemical ionization) the fraction of analyte molecules ionized is approximately $10^{-4}$. In the electron capture method, typically, used for high electron-affinity compounds, the ionization efficiency is higher, about $10^{-2}$. However, few if any fragment ions are usually formed by this method. While an ionization efficiency close to 1 can be achieved with photoionization, it requires very high power lasers and mainly forms atomic ions. Those ions contain very little structural information, which makes identifying more complex molecules virtually impossible.

Mass spectrometers, such as magnetic sector or quadrupole instruments, are almost always used with continuous ionization where analyte ions are continually being formed and analyzed by the appropriate mass spectrometers. Commonly these instruments have a disadvantageous low ion detection efficiency particularly when analyzing ions with a wide range of m/z values. The low ion detection efficiency results because only ions within a limited range of m/z values can be detected at any one time.

In contrast, other types of mass spectrometers, such as time-of-flight instruments, have high ion detection efficiencies, that is, detection of essentially all ions formed. Efforts have been made to use such high ion detection efficient mass spectrometers for the analysis of gaseous compounds by using either a pulsed ionization scheme, or ion storage devices, or a combination thereof. Presently, among the approaches that are not limited to selected compounds, the highest sensitivity method is probably gas phase ionization with subsequent analysis in an ion trap.

Despite the very high sensitivity of current mass spectrometric methods for gas phase analysis, there remains a need to detect even smaller amounts of analytes. Such detection would provide for improved monitoring of gas purity, detection and quantification of trace compounds in the atmosphere, and ultra-sensitive gas chromatographic detection.

There further remains a need for an ionization method that utilizes a microscopically rough surface of a solid substrate to promote in situ adsorption of analyte, ionization, and desorption of the ionized analyte to achieve both increased ionization efficiency of gaseous analytes and increased detection efficiency of the ions formed. Such a method would be an advancement over the known methods. More particularly there remains a need for a method that utilizes in situ adsorption of gaseous analyte to a surface, followed by ionization, and desorption of an ionized gas phase analyte for analysis.

SUMMARY OF THE INVENTION

The present invention is directed to a method and a device for producing an analyte ion, comprising providing a substrate having a non-porous rough surface; contacting an analyte with the non-porous rough surface whereby the analyte interacts with the non-porous rough surface; and upon exposure of the non-porous rough surface to an energy source producing an ionized gas phase analyte.

The inventive said non-porous rough surface is structured to interact with the analyte. More specifically, the non-porous rough surface is structured to promote one or all of the following: adsorption of the analyte onto the surface; formation of ionized analyte on the surface; and desorption of ionized analyte from the surface.

The inventive method could also have the analyte in the gas phase prior to contacting with the non-porous rough surface. The analyte could be gasified prior to contacting with the non-porous rough surface. Thus, the analyte could be originally in the liquid or solid phase prior to a gasification process to produce the desired gaseous analyte. The analyte could also be a gaseous eluate from a gas chromatograph. The analyte could also be present in ambient air, sampled to contact the non-porous rough surface. The gaseous analyte can be added, for example, by either a gas injector or as a gas stream directed towards the non-porous rough surface.

Another embodiment of the present inventive method could also have the analyte in the gas phase prior to contacting with a substrate. The analyte could be gasified prior to contacting with the substrate. Thus, the analyte could be originally in the liquid or solid phase prior to a gasification process to produce the desired gaseous analyte. The analyte could also be a gaseous eluate from a gas chromatograph. The analyte could also be present in ambient air, sampled to contact the substrate. The gaseous analyte can be added, for example, by either a gas injector or as a gas stream directed towards the substrate.

The present invention is ideally suited for use as a highly efficient ion detection device where ions are produced by exposure to a pulsed energy source, such as a laser. The present invention can accumulate analyte then, upon exposure to a laser pulse, desorb gas phase ions. Following the desorption of gas phase ions the surface continues the process of accumulating analyte again. Such a pulsed method can be advantageously used with various existing analytical techniques, including, without limitation, gas chromatography and TOF mass spectrometry.

The surface features of the non-porous rough surface are critical to the invention and are sub-micrometer surface features, generally smaller than about 0.1 $\mu$m. Overall the non-porous rough surface has a surface roughness of between about 10 nm and about 100 nm.

The present inventive substrate comprises at least one member of the group consisting of silicon, carbon, and polymers. Preferably, the substrate is single crystal silicon, or highly oriented pyrolytic graphite. The substrate could also be made from UV or IR light-adsorbing polymers, such as, for example, polystyrene. The non-porous rough surface could also be supported on low heat conductivity material.

There are various methods of roughening the surface of the substrate using a surface roughening treatment. Examples of possible surface roughening treatments are etching with reactive chemicals, bombardment with hyperthermal reactive atoms, bombardment with high-energy particles, irradiation with lasers, exposure to a plasma, vapor deposition, and roughening with mechanical action. The roughening treatment should produce a surface with the desired roughness features on a non-porous surface. The roughening treatment must not render porous the substrate or surface on which the rough features are formed.

The present method can also include a method of analyzing a physical property of the ionized gas phase analyte. Such analysis could be performed by any of the following: mass spectrometry, ion mobility spectrometry, and a current measurement device. Any number of analytical methodologies that measure physical properties of ions could be utilized in the present method.

A matrix could also be added to the non-porous rough surface to further interact with the analyte. Possible matrix materials include, for instance, water, glycerol, and acetic acid. The matrix could be added to the non-porous rough surface by adsorption of gas phase matrix material. The addition of the matrix could occur both before and after exposing the non-porous rough surface to an energy source. The addition of the matrix to the non-porous rough surface could occur in situ or in a different place than the place where exposure of the substrate to an energy source occurs. Additionally, the addition of the matrix to the non-porous rough surface could occur simultaneous with contacting the gaseous analyte to the non-porous rough surface.

The exposure of the non-porous rough surface to an energy source may be accomplished by irradiating the surface with laser light. Preferably, the surface is exposed to an energy source in a pulsed manner.

The substrate could also be cooled prior to contacting the analyte with the non-porous rough surface. Preferable, the substrate is cooled to a range of about −140° C. to about −80° C. Most preferably, the substrate is cooled enough to cause formation and reformation of condensed matrix vapor, for example, water vapor, on the substrate between laser pulses.

The irradiation of the non-porous rough surface can occur with light of a wavelength absorbed by either of the non-porous rough surface or a matrix added to the non-porous rough surface. Preferably, UV or IR light produced by a laser is utilized. Particularly, 337 nm UV laser and/or 3.28 $\mu$m IR laser light is used for desorption of the absorbed analyte from the non-porous rough substrate surface.

The inventive method can be performed under ambient pressure or low pressure. Low pressure means from about $10^{-4}$ to about $10^{-6}$ torr, or typical pressures seen in a TOF mass spectrometer, for example.

The contacting of an analyte to the non-porous rough surface can occur in situ, that is, at the same location, where the non-porous rough surface is exposed to an energy source. Thus, where the exposure to an energy source is accomplished by means of, for instance, laser pulses, and the gaseous analyte is present in situ, then the gaseous analyte contacts the substrate surface both before and after exposure of the non-porous rough surface to a pulsed energy source. Hence, the analyte may be contacting the substrate surface to effectively regenerate coverage on the surface between laser pulses.

The present invention is also directed to an apparatus to perform the above described process, or more specifically, a device for generating analyte ions, which features a substrate having a non-porous rough surface; means for exposing an analyte to the non-porous rough surface whereby the analyte interacts with the non-porous rough surface; and an energy source to supply energy at the non-porous rough surface to generate ionized gas phase analyte.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detailed description serve to explain the principles of the invention.

DETAILED DESCRIPTION OF THE PREFERRED EMBODIMENTS OF THE INVENTION

The invention relates to methods and devices for the ionization of analytes for analysis by various analytical techniques, such as, mass spectrometry, ion mobility spectrometry, and current measurement devices, for example. Generally, the present invention is directed to use of a non-porous rough surface to which an analyte is adsorbed, then upon exposing the surface to an energy source such as laser light, the analyte is released or desorbed as an ionized analyte. Moreover the present invention is directed to in situ adsorption of an analyte to an ionization surface for subsequent ionization. Specifically the invention is directed to the in situ gas phase adsorption of a gaseous analyte to a substrate surface, which may be non-porous and rough, with subsequent ionization by light to produce a gas phase ionized analyte.

The preparation of exemplary inventive substrates, addition of the analyte to the substrate, and subsequent ionization and desorption of the analyte from the substrate are set forth below. Additional experiments and further experimental details to support the mechanisms proposed to occur on the inventive substrates are set forth in Alimpiev, S., et al., *J. Chem. Physics,* 2001, 115, 1891–1901, the disclosure of which is herein incorporated in its entirety.

The porous silicon substrates used as comparative examples were produced under a variety of etching conditions. The etching conditions utilized for comparative testing resulted in substrate surfaces with porous layers, such as seen in the substrates utilized in U.S. Pat. No. 6,288,390.

Mass spectra were obtained from the inventive silicon substrate that had been etched using hyperthermal fluorine atoms to a calculated roughness thickness of only approximately 10 nm, as illustrated in FIG. 2*b*. This exemplary inventive silicon surface yielded ions, which illustrated that substrate porosity was not required for ion desorption. Erosion by energetic beams of directed neutrals is known to form rough surfaces while involving no known process by which pores would be formed. See T. K. Minton and D. J. Garton, "Dynamics of Atomic-Oxygen-Induced-Polymer Degradation in Low Earth Orbit," in *Chemical Dynamics in Extreme Environments: Advanced Series in Physical Chemistry,* ed. R. A. Dressler (World Scientific, Singapore, 2001).

Figure 1:
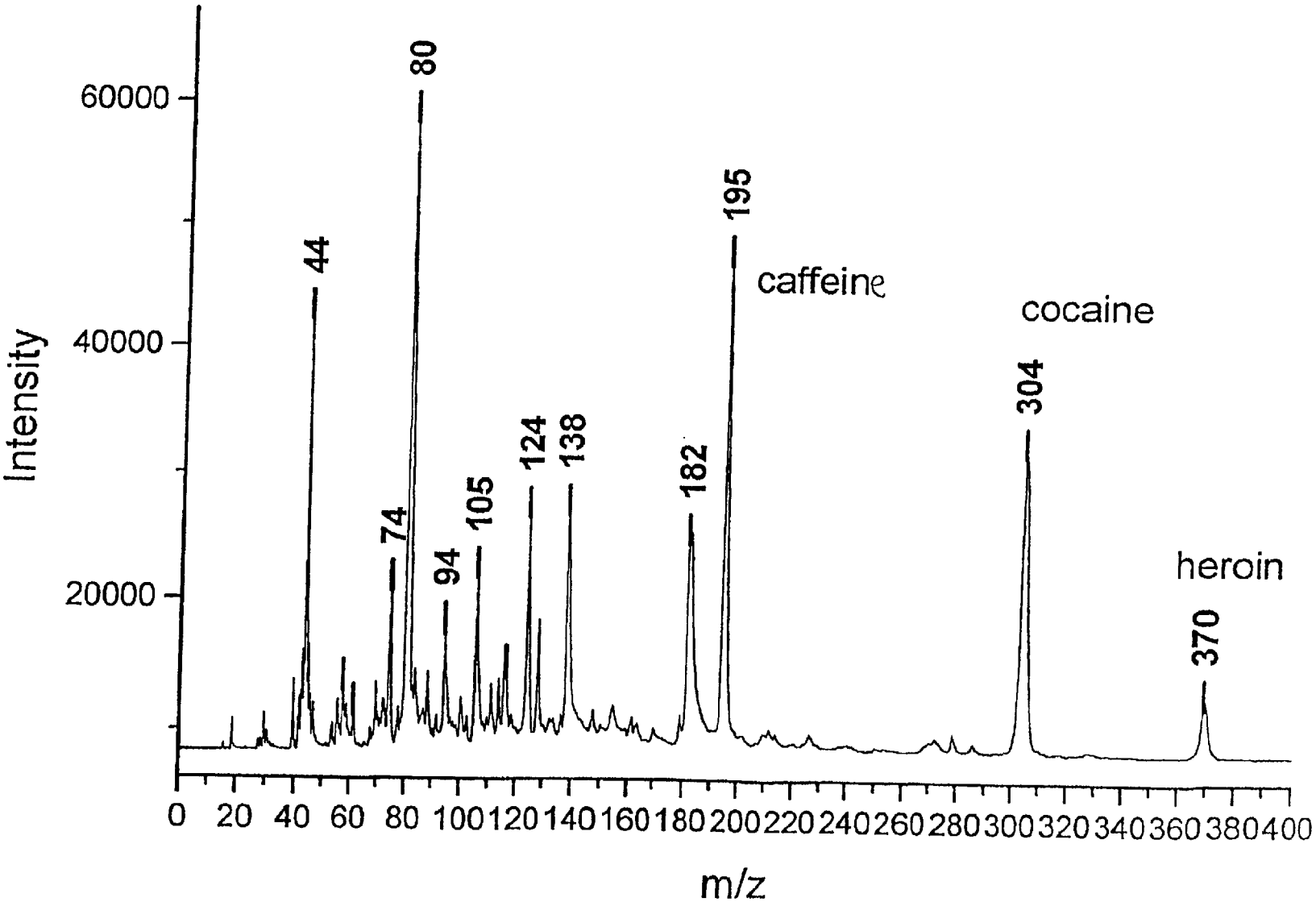
FIG. 1. Mass spectra obtained from the vapors of caffeine, cocaine, and heroin. The vapor pressure of each was approximately in the range from $10^{-11}$ to $10^{-9}$ torr, and the room temperature rough substrate was exposed to the vapors in situ.
Figure 2:
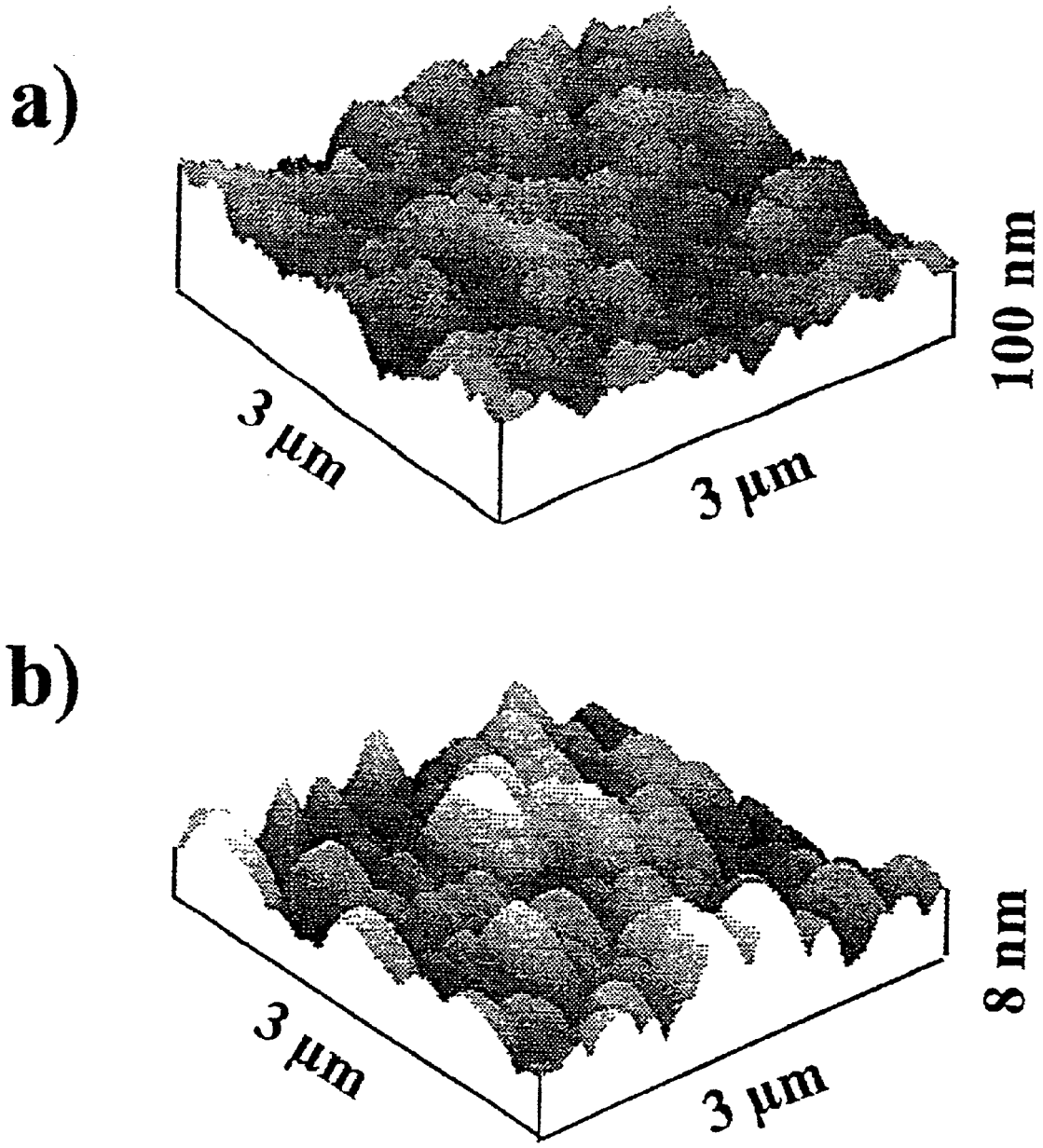
FIG. 2. Atomic force microscopy images of a) porous silicon (sample PS2), and b) F-etched silicon, which has been prepared according to the principles of the present invention. Due to different horizontal and vertical length scales, the height differences are not to scale in these images. The scale of the vertical height axis for FIG. 2*a* is over ten times greater than that of FIG. 2*b*.

The comparative roughness of the two surfaces resulting from HF etching and from hyperthermal F atoms etching is clearly shown in the atomic force microscopy images of a) porous silicon sample PS2 and b) a silicon surface etched with hyperthermal F atoms set forth in FIG. 2. The image, FIG. 2*a*, of the porous silicon sample shows that the etching process, that is known to create a sub-surface porous structure, also creates a highly pitted and irregular surface.

The requirement that a substrate be rough in order to produce gas phase ions, is in agreement with earlier reports on powder SALDI by Sunner et al. See J. Sunner, E. Dratz, Y. -C. Chen, *Anal. Chem.* 67, 4335 (1995) and S. Alimpiev, Y. -C. Chen, E. Dratz, P. Kraft, and J. Sunner, In Proceedings of the 44th ASMS Conference on Mass Spectrometry and Allied Topics, Portland, Oreg., May 12–16, p. 641 (1996). In this earlier work, ion desorption was observed from solid carbon particles that projected out of a liquid matrix surface. It is believed that the porosity of the silicon is not directly involved in the ion desorption process. Furthermore, a comparison of the AFM images in FIG. 2 shows that both F-atom etched surfaces and porous silicon have sub-micron-sized surface structures.

It was found that UV laser desorption mass spectra were also obtained from F-atom-etched silicon surfaces. As a control, it was confirmed that no ion signals were obtained when the laser was focused onto surface areas that had been masked during the F-atom etching procedure, that is, a non-rough surface did not produce an ion signal.

Figure 3:
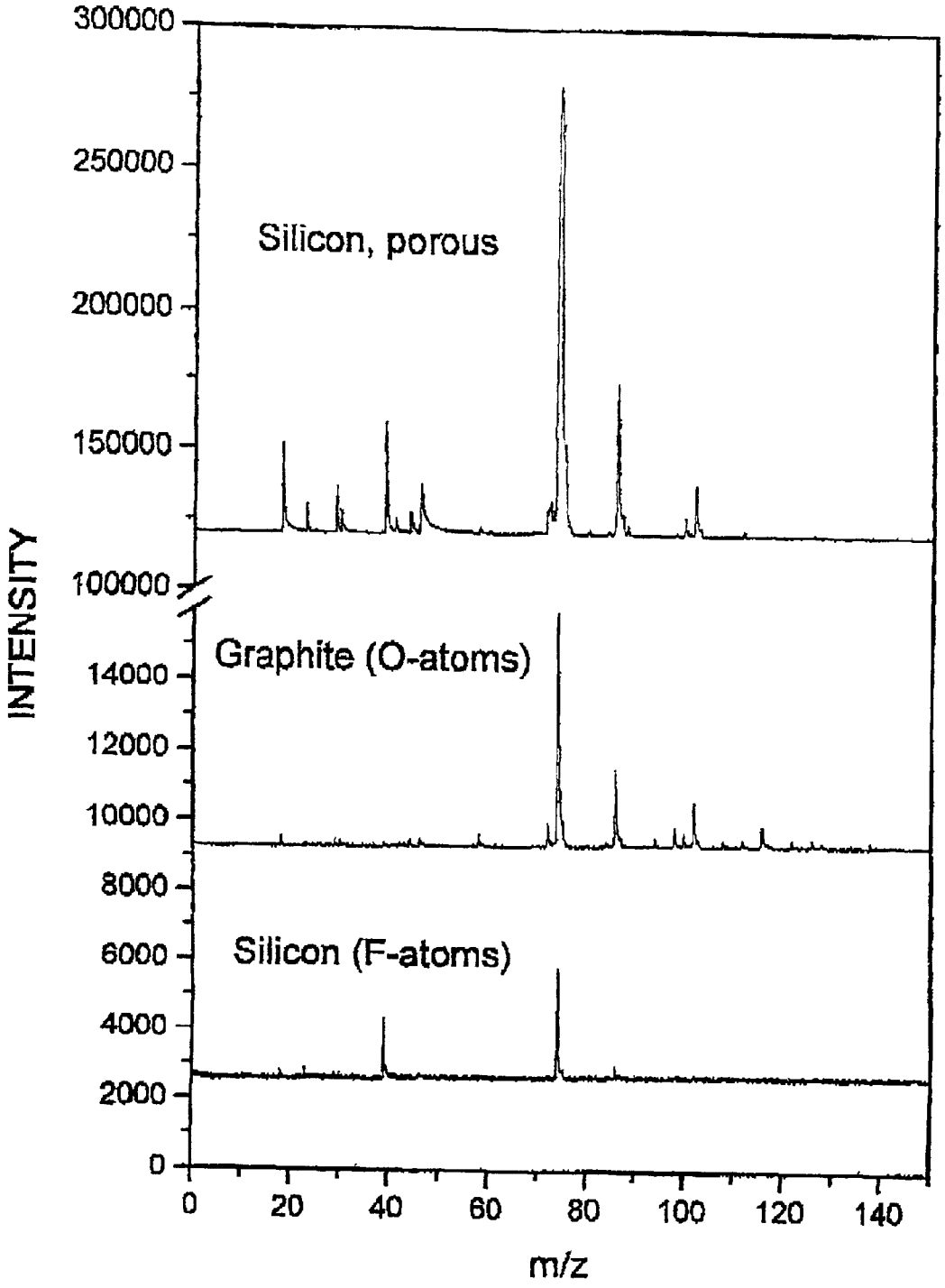
FIG. 3. Comparison of UV-laser-induced mass spectra of gas-phase-introduced diethylamine (m/z=74) obtained from porous silicon (PS1); from HOPG carbon etched with hyperthermal O-atoms; and from silicon etched with hyperthermal F-atoms. The pressure of diethylamine was approximately $10^{-8}$ torr. Several minor peaks are due to gas-phase impurities at the $10^{-10}$ torr level.

Because SALDI mass spectra have generally been obtained from carbon powder suspensions, HOPG (highly oriented pyrolytic graphite) substrates were also treated to produce a rough surface. From top to bottom, FIG. 3 shows mass spectra of gas-phase-introduced diethylamine obtained from porous silicon (PS1), from HOPG etched with O atoms, and from silicon etched with F atoms, respectively. These mass spectra were all obtained on the same day and under the same experimental conditions of laser repetition rate (20 Hz), UV laser pulse fluence (50 mJ/cm$^2$), diethylamine pressure (approx. $10^{-8}$ torr), and substrate temperature (30° C.). The base peak in all three spectra is protonated diethylamine at m/z=74. However, the mass spectrum obtained from porous silicon (PS1) is about 50 times more intense than the spectrum obtained from F-etched silicon, believed to be due to the relatively shallow roughness depth of the F-etched silicon. Peaks due to $Na^+$ and $K^+$ were seen in all spectra. Other minor peaks are due to basic compounds, such as ammonia, pyridine and piperidine, that remained at trace concentrations in the vacuum manifold for several days after having been introduced into the ion source. There are notable differences in the relative intensities of these minor peaks even though the concentrations of the trace compounds remained essentially constant. The porous and non-porous substrates also displayed very different behavior with varying exposure time in the ion source, as discussed below.

Figure 4:
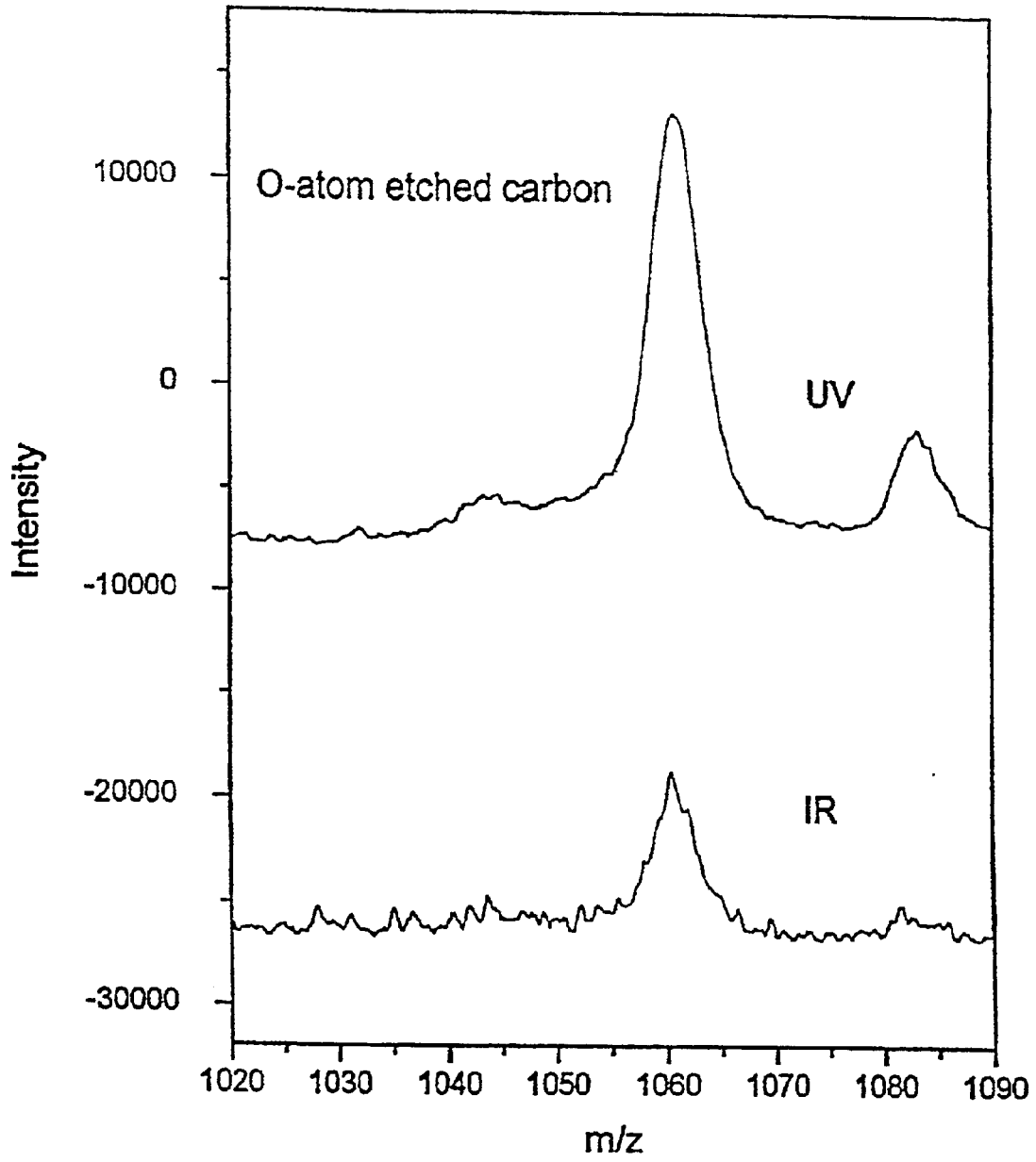
FIG. 4. Molecule ion region of mass spectra of bradykinin, obtained from hyperthermal, O-atom etched HOPG. The peptide was added by solvent deposition and desorbed using the nitrogen UV laser.

The fact that mass spectra were obtained also from the oxygen-atom-etched HOPG surfaces, FIG. 3, shows that the desorption/ionization process studied here is not restricted to silicon substrates. Indeed, the mass spectra obtained from similarly etched carbon were very similar to those obtained from silicon. As was the case for the silicon surfaces, the O-atom-etched carbon substrate yielded mass spectra also by liquid sample deposition. To illustrate, FIG. 4 shows the molecule ion region of bradykinin mass spectra obtained on an oxygen-atom-etched HOPG substrate with the UV and IR lasers, respectively.

The reactive atom-etched HOPG is of a very high purity, and it is noteworthy, as seen in FIG. 3, that the $Na^+$ and $K^+$ ion peaks were of very low intensity from these carbon substrates. This contrasts with previous powder SALDI spectra, obtained using carbon of lower purity, in which the $Na^+$ and $K^+$ peaks were often very intense. See J. Sunner et al. *Anal. Chem.* cited above and Y. -C. Chen, Ph.D. thesis, Montana State University (1997).

Stark differences in the time between successive laser pulses needed to achieve steady state analyte ion intensities are also observed between the porous substrates and the inventive non-porous rough surfaces. See FIG. 5. For porous silicon surfaces, the approach to the new steady-state intensity (i.e. the intensity plotted in FIG. 5) was very sluggish, and it could take up to 20 minutes for the spectra to stabilize. In clear contrast, the mass spectra from the non-porous, F-etched silicon surfaces reached a new steady state analyte ion intensity within a few seconds. Such a rapid response is essential when using the inventive method for monitoring purposes such as a GC (gas chromatography) detector.

The single laser shot ion abundances of gas-phase introduced analytes were found to depend strongly on the laser repetition rate. At room temperature, stable ion intensities were approached as the time interval between successive laser pulses was increased. The time interval between successive desorption laser pulses will here be referred to as the "surface recovery time." The surface recovery time is believed to be a function of the chemical composition of materials adsorbed on the surface and reflects the time needed for the reestablishment of a steady-state thickness on the surface between laser pulses.

Figure 5:
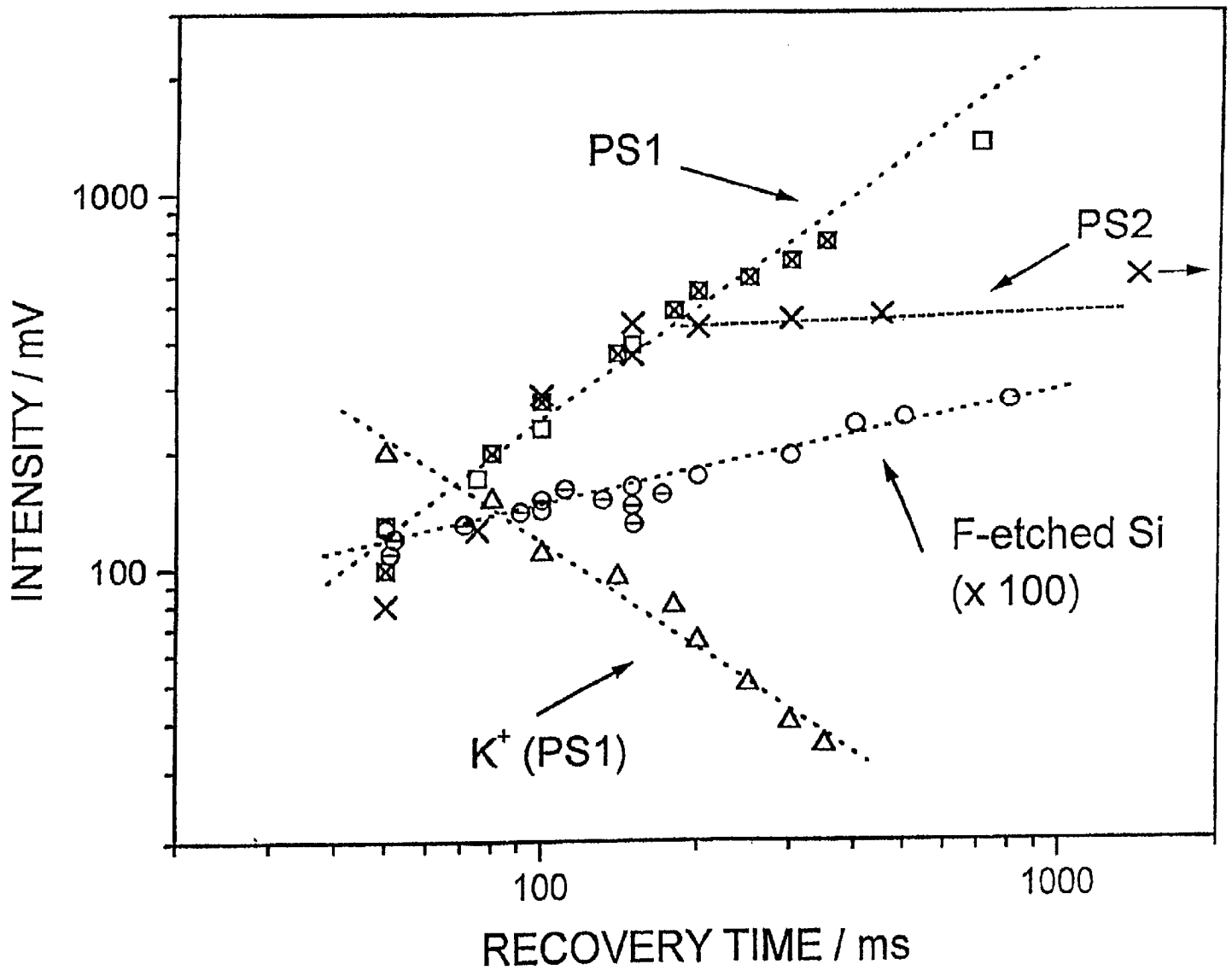
FIG. 5. Single-laser pulse ion abundances of protonated diethylamine as a function of the time between successive laser shots for porous silicon (PS1); porous silicon PS2, and F-atom etched silicon and of $K^+$ from porous silicon (PS1). The pressure of diethylamine was $5\times10^{-8}$ torr.

Single-shot mass spectra of gas-phase introduced diethylamine ($p=5\times10^{-8}$ torr) were recorded as a function of the laser repetition rate for several different silicon and carbon substrates. Selected room-temperature results are shown in FIG. 5, in which ion abundances are plotted as a function of the surface recovery times, from 50 ms to 1 s, corresponding to laser repetition rates from 20 Hz to 1 Hz. Line labeled "PS1" shows the abundance of protonated diethylamine obtained from the PS1 porous silicon substrate. The single-shot ion abundance increased approximately linearly with time, as shown by the good fit to the dotted line with a slope of one in this double-logarithmic diagram. However, a curvature in the data was consistently observed, and below 0.1 seconds, the slope was consistently larger than one. Concurrent with the increase in the analyte ion abundance, there was a decrease in the intensity of the $K^+$ ion, as shown for the PS1 substrate in FIG. 5.

At recovery times longer than 1 second, the analyte ion signal was unstable and showed large shot-to-shot variations under the conditions of analyte pressure, UV laser intensity, and substrate temperature for the PS1 substrate. This instability was suppressed if the laser intensity was increased to the maximum available value of 150 mJ/cm$^2$, or if the analyte pressure was decreased. Cooling the substrate also yielded more stable ion signals. Under conditions that yielded stable ion signals, it was found that the signal intensity from PS1 continued to increase at times from 1 second to several minutes with an approximately square root dependence.

The other porous silicon sample, PS2, was etched under conditions identical to those of PS1, except that the PS2 sample did not undergo halogen lamp irradiation during etching. As shown by the "PS2" labeled line in FIG. 5, the behavior of PS2 was very similar to that of PS1 at surface recovery times less than 0.2 seconds. However, in sharp contrast to PS1, the analyte ion signal from PS2 was found to saturate above 0.2 seconds, with insignificant changes in intensity up to surface recovery times as long as 5 minutes.

For the present inventive F-atom etched Si surface, the analyte ion intensities were about 2 orders of magnitude smaller than those obtained from porous silicon at a 20 Hz laser repetition rate. The single-shot analyte ion abundance also increased more slowly with increasing surface recovery time, with a power dependence of about 0.3, as seen in FIG. 5.

The emitted ion intensities for the three substrates were found to vary only weakly with the ion extraction field. As the field strength was decreased ten-fold, from 8,000 V/cm to 800 V/cm, the analyte (diethylamine) ion current, as well as the potassium ion current, decreased by a factor of four.

The porous structures of PS1 and PS2 clearly play a role by re-supplying the ionization surface with analyte after each laser pulse. This effect is seen in the very sluggish response (up to 20 minutes) of the analyte ion signal from porous silicon (PS1 and PS2) to changes in the partial pressure of the analyte in the ion source. This sluggish response contrasts sharply with the much faster response (a few seconds) for the inventive non-porous, reactive atom-etched, silicon and carbon surfaces. The different ion signals and the very different saturation behaviors seen for the different substrates in FIG. 5 are understood to be due to differences in analyte transport and adsorption resulting from the different porosities of the ionization surfaces and substrates.

Analyte gas mixtures were prepared in a separate chamber equipped with a septum to permit addition by injection of a volume of liquid analyte or its saturated vapor through the septum into the chamber. The vapor could also be produced by any method of gasification, such as sublimation or evaporation of a solid or liquid phase analyte, respectively. The chamber was initially filled with an inert gas (such as krypton) to prevent reaction with moisture and/or contamination from trace compounds found in laboratory air. After injection of the analyte and equilibration, the gas mixture was admitted into the ions source, where the substrate surface was located, through a capillary and GC injection valve. Thus, the substrate surface was exposed to the analyte in situ, in the instrument.

The device for use with the above-described method generates ions using the non-porous rough surface substrate. The non-porous rough surface is exposed to analyte as described above such that the analyte interacts with the non-porous rough surface. The device further includes an energy source to supply energy at the non-porous rough surface to generate ionized gas phase analyte.

The device of the present invention is also directed to a device which features in situ contacting of a substrate with gaseous analyte with exposing the substrate and contacted analyte to an energy source to desorb gas phase ionized analyte.

Measurement of Surface Roughness

For the substrate surfaces, the surface roughness was studied by Atomic Force Microscopy (AFM) profilometry. In this method, a very sharp stylus is scanned over the surface with the height of the surface being measured at points which were 12 $\mu$m apart.

Statistical analysis of the AFM images yields the following surface roughness measurements. The Ra value (or center plane average) is defined as $Ra=[\Sigma(z_i-z_{ave})/N]$, where $z_i$ is the measured height at a given point on the surface, $z_{ave}$ is the average height, N is the number of measured points, and the summation is performed over all measured points. A related measure is the rms roughness, $Rms=[\Sigma(z_i-z_{ave})^2/N]^{1/2}$.

The surface area of the measured substrate surface is defined as the total area of all triangles defined by the measured points, and the surface area difference is the % increase in the latter surface area over the area of a corresponding completely flat surface.

The grain size is the average lateral extension of areas above or below a given cut-off height, such as the plane defined by $z_{ave}$. The size of the surface features or roughness features in the lateral direction is also obtained from Fourier transforms. The result is a so-called power spectrum that gives the "power" as a function of length.

The substrate surfaces of the present invention, have Ra and Rms values that both range from about 2 to about 100 nm. Higher roughness values, greater than 20 nm, are preferred. The surface area difference varies from approximately 1% to approximately 40%. Higher values, between about 20% and about 40%, are preferred. The grain size varies from approximately 0.01 $\mu$m to approximately 1 $\mu$m. The power spectrum for the substrate surfaces of the present invention shows a gradually decreasing roughness over a range from approximately 1 $\mu$m to about 20 nm.

Mass Spectrometry Measurement Instrumentation and Procedures

A modified Vestec 2000 time-of-flight mass spectrometer (PerSeptive Biosystems, Framingham, Mass.) with a 1.35 m linear flight path was used for the present work. Detailed information can be found in P. Kraft, S. Alimpiev, E. Dratz, and J. Sunner, *J. Am. Soc. Mass Spectrom.* 9, 912 (1998). The mass resolution of the instrument used herein was significantly improved by modifications to the ion detector and to the detector circuitry. The acceleration voltage was 20,000 V. The extraction field was 8,000 V/cm applied over a distance of 2.5 cm. All mass spectra were obtained in positive ion mode. A guidewire was maintained at −120 V. Time-of-flight mass spectra were recorded on a Tektronix TDS520, 500 MHz oscilloscope and downloaded onto a PC. Internal mass calibration was used throughout.

The samples were attached, using conductive Ni paint, to a 5 mm diameter copper surface at the tip of a ¼" insertion probe. The probe tip was in thermal and electrical contact with the high-voltage extraction electrode. The temperature of this electrode was varied from −140° C. to +25° C. by means of a cold finger that extended to outside of the ion source. A TV camera (Watec 902, Edmund Scientific, Barrington, N.J.) was used to view the sample surface on a monitor with a 19× magnification.

For UV-induced laser desorption, a 337 nm nitrogen laser (LSI Lasers, Newton, Mass.) was used. The laser pulse energy was varied in the 5 to 30 $\mu$J range using an attenuator. The size of the focal spot was determined to be about 0.02 $mm^2$.

For IR-induced laser desorption, a laser system consisting of a Nd:YAG pumped KTP OPO crystal (Big Sky Laser, Bozeman, Mont.) was used. This laser yielded a fixed-wavelength 3.28 $\mu$m, OPO-idler laser beam with a 6 ns pulse length. The pulse energy was varied in steps to a maximum of about 3.5 mJ. A typical pulse energy used in this work was 3 mJ. The incidence angle of the IR beam onto the sample was 30°. The focal spot was thus ellipsoidal.

The 3.28 $\mu$m laser beam contained lower-intensity beams at 1.57 $\mu$m and 1.064 $\mu$m. The 1.064 $\mu$m beam induced intense fluorescence from porous silicon. A germanium plate was occasionally inserted into the beam path to filter out the 1.57 $\mu$m and 1.064 $\mu$m laser beams. This did not result in any significant changes in the mass spectra, when compared at the same 3.28-$\mu$m laser pulse energy.

The focal spot size for the 3.28-$\mu$m IR-laser beam was obtained as follows. A pre-cooled sample was inserted into the ion source and a thin frost layer was formed on the sample surface. The first few laser shots (with the 1.57 $\mu$m and 1.064 $\mu$m beams removed by the Ge plate) ablated the frost layer with the surface undergoing a marked change in visual appearance. By measuring on the monitor, it was found that the area of the ablated spot was 0.5 $mm^2$. With a pulse energy of 3.0 mJ, and subtracting 10% Fresnel losses in the focusing lens and 10% reflection losses in the vacuum chamber window, the energy fluence in the focal spot is calculated to be 0.5 $J/cm^2$. By correcting for the 30° incidence angle, the fluence perpendicular to the beam is found to be 1.0 $J/cm^2$.

Method of Introducing Gaseous Analytes into the Ion Source

A 200 mL glass chamber equipped with a septum was used to prepare analyte gas mixtures. The chamber was filled with an inert gas (krypton) to prevent the addition of moisture and/or trace contaminants found in laboratory air. A volume of liquid analyte or its saturated vapor was then injected through the septum into the chamber. After equilibration, the gas mixture was admitted into the ions source through a capillary and GC injection valve. The pressure of the gas mixture in the ion source was monitored with a Bayard-Alpert ionization gauge.

Atomic Force and SEM Microscopy

SEM images of silicon and carbon surfaces were obtained with a Hitachi 600 instrument. Tapping mode AFM images were obtained with a Digital Instruments Dimension 3100 system using a silicon tip with a 5–10 nm tip diameter.

EXAMPLES

All chemicals were obtained commercially and used without further purification.

Example 1

Porous silicon samples were produced by galvanostatic anodization as described by Dneprovskii et al. and Klimov et al. using both p-type (B-doped, 12 Ω×cm) and n-type (Sb-doped, 0.01 Ω×cm) silicon. Si wafers in (100) and (111) orientations were etched for 5 to 500 seconds with current densities ranging from 3 to 75 mA/cm$^2$ in a two chamber Teflon cell with platinum electrodes. The etching solution was a 1:1 mixture of concentrated (50%) HF in ethanol. For some n-type samples, a 70 W halogen lamp was used to irradiate the silicon during etching. The effect of halogen lamp irradiation is reported by Cullis et al. to produce narrower pores at a higher density. The etching parameters for the porous silicon ("PS1") sample mentioned above were n-type Si for 20 sec with 75 mA/cm$^2$ under halogen lamp irradiation.

Example 2

The second porous silicon sample "PS2" was etched under the same conditions as PS1 above, but with no halogen lamp irradiation. The depth of the porous structure in silicon, obtained during the galvanostatic anodization, is approximately 1 μm per 6,000 mAs/cm$^2$ according to Klimov et al. The estimated etching depth for each of PS1 and PS2 is thus 0.25 μm.

Example 3

Silicon was also etched at normal incidence in a beam of hyperthermal reactive atoms. Beams containing either hyperthermal fluorine or oxygen atoms with translational energies of approximately 5 eV were prepared with the use of a pulsed laser-detonation source. This process was described by K. P. Giapis, T. A. Moore, and T. K. Minton, *J. Vac. Sci. Technol. A* 13, 959 (1995) and T. K. Minton and D. J. Garton, "Dynamics of Atomic-Oxygen-Induced-Polymer Degradation in Low Earth Orbit," in *Chemical Dynamics in Extreme Environments: Advanced Series in Physical Chemistry,* ed. R. A. Dressler (World Scientific, Singapore, 2001).

Samples were mounted 38 cm from the beam source. An Si(100) sample was cleaned and exposed, as described by Giapis et al., for 10,000 pulses of the F-atom beam, resulting in an exposure fluence of approximately $10^{19}$ F atoms cm$^{-2}$.

Example 4

A highly oriented pyrolytic graphite (HOPG) surface was also etched at normal incidence in a beam of hyperthermal reactive atoms as described above. An HOPG sample (basal plane) was cleaved in air and subsequently exposed to 25,000 pulses of a hyperthermal beam containing roughly equal fractions of atomic and molecular oxygen. The O-atom exposure fluence is estimated to be approximately $5\times10^{18}$ O atoms cm$^{-2}$.

Although the preferred embodiments of the present invention have been described in detail with reference to the examples above, it is understood that various modifications can be made without departing from the spirit or scope of the invention. All cited patents and any other publications referred to in this application are hereby incorporated by reference in their entireties.

What we claim is:

1. A method of producing an analyte ion, comprising providing a substrate having a non-porous rough surface;

contacting an analyte with said non-porous rough surface such that said analyte interacts with said non-porous rough surface; and exposing said non-porous rough surface to a laser to produce a ionized gas phase analyte, wherein said contacting of said analyte with said non-porous rough surface occurs in situ before and after exposing said non-porous rough surface to the laser.

2. A method according to claim 1, wherein the analyte contacting the non-porous rough surface is a gaseous analyte.

3. A method according to claim 2, wherein the contacting of the gaseous analyte occurs by means of either a gas injector or as a gas stream directed towards said non-porous rough surface.

4. A method according to claim 1, wherein said non-porous rough surface has a surface roughness of between about 2 nm and about 100 nm.

5. A method according to claim 1, wherein said non-porous rough surface has a surface roughness of less than about 1 μm.

6. A method according to claim 1, wherein the substrate comprises at least one member of the group consisting of silicon, carbon, and polymers.

7. A method according to claim 6, wherein the substrate is single crystal silicon.

8. A method according to claim 6, wherein the substrate is highly oriented pyrolytic graphite.

9. A method according to claim 1, wherein said non-porous rough surface is supported on low heat conductivity material.

10. A method according to claim 1, further comprising a step of roughening the surface of the substrate using a surface roughening treatment.

11. A method according to claim 10, wherein said surface roughening treatment comprises at least one member selected from the group consisting of etching with reactive chemicals, bombardment with hyperthermal reactive atoms, bombardment with high-energy particles, irradiation with lasers, exposure to a plasma, vapor deposition, and roughening with mechanical action.

12. A method according to claim 1, further comprising a step of analyzing a physical property of the ionized gas phase analyte.

13. A method according to claim 12, wherein said analysis is performed by means of at least one member selected from the group consisting of mass spectrometry, ion mobility spectrometry, and a current measurement device.

14. A method according to claim 1, further comprising a step of cooling the substrate prior to contacting the analyte with the non-porous rough surface.

15. A method according to claim 1, further comprising a step of adding a matrix to the non-porous rough surface.

16. A method according to claim 15, wherein the matrix is at least one member selected from the group consisting of water, glycerol, and acetic acid.

17. A method according to claim 15, wherein the addition of the matrix to the non-porous rough surface occurs by adsorption of gas phase matrix material.

18. A method according to claim 15, wherein the addition of the matrix to the non-porous rough surface occurs in situ with exposing the non-porous rough surface to a laser.

19. A method according to claim 1, wherein the analyte is a gaseous eluate from a gas chromatograph.

20. A method according to claim 1, wherein the analyte is obtained from ambient air.

21. A method according to claim 1, wherein said non-porous rough surface is irradiated with light of a wavelength absorbed by either of the non-porous rough surface or a matrix added to the non-porous rough surface.

22. A method according to claim 1, wherein the method is performed under ambient pressure.

23. A method according to claim 2, wherein said laser repeatedly pulses said non-porous rough surface with laser light, and the contacting of the analyte to the non-porous rough surface occurs during and between the laser pulses.

24. A device for generating analyte ions comprising substrate having a non-porous rough surface with a surface roughness of between about 2 nm and about 100 nm; and means for exposing an analyte to the non-porous rough surface whereby the analyte interacts with the non-porous rough surface; and energy source to supply energy at the non-porous rough surface to generate ionized gas phase analyte.

25. A device according to claim 24, wherein said non-porous rough surface is structured to interact with the analyte.

26. A device according to claim 25, wherein said non-porous rough surface is structured to promote the adsorption of the analyte on said surface.

27. A device according to claim 25, wherein said non-porous rough surface is structured to promote the formation of ionized analyte on said surface.

28. A device according to claim 25, wherein said non-porous rough surface is structured to promote the desorption of ionized gas phase analyte from said surface.

29. A device according to claim 24, wherein the substrate comprises at least one member of the group consisting of silicon, carbon, and polymers.

30. A device according to claim 29, wherein the substrate is single crystal silicon.

31. A device according to claim 29, wherein the substrate is highly oriented pyrolytic graphite.

32. A device according to claim 24, wherein said non-porous rough surface is supported on low heat conductivity material.

33. A device according to claim 24, further comprising:

a laser for irradiating the substrate to produce an ionized gas phase analyte; and means for determining a physical property of the ionized gas phase analyte.

34. A device according to claim 33, wherein said means is at least one member selected from the group consisting of mass spectrometry, ion mobility spectrometry, and a current measurement device.

35. A device according to claim 24, wherein said means for exposing an analyte comprises either a gas injector or a gas stream directed toward said non-porous rough surface.

36. A method of producing an analyte ion comprising:

providing a substrate with a surface roughness of between about 2 nm and about 100 nm;

contacting a gaseous analyte with the substrate; and exposing the substrate to an energy source to produce an ionized gas phase analyte.

37. A method according to claim 36, wherein the contacting of the gaseous analyte occurs by means of either a gas injector or as a gas stream directed towards said substrate.

38. A method according to claim 36, further comprising a step of analyzing a physical property of the ionized gas phase analyte.

39. A method according to claim 38, wherein said analysis is performed by means of at least one member selected from the group consisting of mass spectrometry, ion mobility spectrometry, and a current measurement device.

40. A method according to claim 36, further comprising a step of cooling the substrate prior to contacting the analyte with the substrate.

41. A method according to claim 36, further comprising a step of adding a matrix to the substrate.

42. A method according to claim 41, wherein the matrix is at least one member selected from the group consisting of water, glycerol, and acetic acid.

43. A method according to claim 41, wherein the addition of the matrix to the substrate occurs by adsorption of gas phase matrix material.

44. A method according to claim 41, wherein the addition of the matrix to the substrate occurs in situ with exposing the substrate to an energy source.

45. A method according to claim 36, wherein the analyte is a gaseous eluate from a gas chromatograph.

46. A method according to claim 36, wherein the analyte is obtained from ambient air.

47. A method according to claim 36, wherein said substrate is irradiated with light of a wavelength absorbed by either of the substrate or a matrix added to the substrate.

48. A method according to claim 36, wherein the method is performed under ambient pressure.

49. A method according to claim 36, wherein said energy source is a laser.

50. A method according to claim 49, wherein said laser repeatedly pulses said substrate with laser light, and the contacting of the analyte to the substrate occurs during and between the laser pulses.

51. A method of producing an analyte ion comprising the steps of:

1) interacting a gaseous analyte with a surface of a substrate having a non-porous rough surface;

2) producing an ionized gas phase analyte by irradiating the substrate with a laser; and 3) repeating step 1) in situ.

52. The method according to claim 51, further comprising a step of repeating step 2) in situ.

53. The method according to claim 51, further comprising a step of analyzing a physical property of the ionized gas phase analyte.

54. The method according to claim 52, wherein said analysis is performed by means of at least one member selected from the group consisting of mass spectrometry, ion mobility spectrometry, and a current measurement device.

55. The method according to claim 51, further comprising the step of roughening a surface of the substrate to have a surface roughness of between about 2 nm and about 100 nm.

56. A device for generating analyte ions comprising a substrate having a non-porous rough surface having a surface area difference that varies from approximately 20% to approximately 40%; and means for exposing an analyte to the non-porous rough surface whereby the analyte interacts with the non-porous rough surface; and an energy source to supply energy at the non-porous rough surface to generate ionized gas phase analyte.

57. The device of claim 56, wherein a grain size of the surface area varies from approximately 10 nm to 1000 nm.

58. The device of claim 56, wherein a surface roughness of the surface area is between about 2 nm and about 100 nm.

59. A device for generating analyte ions using a laser comprising:

a substrate having a non-porous rough surface with a surface roughness of between about 2 nm and about 100 nm; and an analyte interacted with the non-porous rough surface.

60. A device for generating analyte ions using a laser to a non-porous rough surface substrate, wherein an area of the substrate has a surface roughness of between about 2 nm and about 100 nm and having a surface area difference that varies from approximately 20% to approximately 40%.

61. The device of claim 60, wherein a grain size of the surface area varies from approximately 10 nm to 1000 nm.

* * * * *